United States Patent [19]

Goel

[11] 4,010,692

[45] Mar. 8, 1977

[54] PROCESS FOR TAMPING RAILWAY TRACKS AND A MOVABLE MACHINE FOR EFFECTING THE PROCESS

[75] Inventor: Pierre Goel, Vaud, Switzerland

[73] Assignee: Matisa Materiel Industries S.A., Vaud, Switzerland

[22] Filed: Dec. 19, 1975

[21] Appl. No.: 642,353

[30] Foreign Application Priority Data

Jan. 17, 1975 Switzerland ..... 568/75

[52] U.S. Cl. ..... 104/12; 104/7 R

[51] Int. Cl.[2] ..... E01B 27/16

[58] Field of Search ..... 104/12, 7 R; 73/67.2, 73/67.3, 67.4, 146

[56] References Cited

UNITED STATES PATENTS

| | | | |
|---|---|---|---|
| 3,401,642 | 9/1968 | Fisher | 104/12 X |
| 3,465,688 | 9/1969 | Sauterel | 104/12 |
| 3,807,311 | 4/1974 | Plasser et al. | 104/12 |
| 3,895,583 | 7/1975 | Theurer | 104/12 |

FOREIGN PATENTS OR APPLICATIONS

| | | | |
|---|---|---|---|
| 152,993 | 8/1953 | Australia | 104/12 |

*Primary Examiner*—Robert J. Spar
*Assistant Examiner*—Randolph A. Reese

[57] ABSTRACT

A process and a machine for tamping railway tracks so as to obtain the same degree of compactness of the ballast under all the sleepers of the track tamped by the machine. A movable tamping machine with vibratory tamping tools tamps the ballast between and under the sleepers. A pick-up device measures the amplitude of vibrations retransmitted by the ballast across the sleepers and the rails to a part of the machine which is maintained in non-elastic connection with one rail of the track. The pick-up is rigidly fixed to this part of the machine. A computer is provided to emit a control signal to a control device for stopping the compacting operation of the tools. This signal is emitted when a predetermined value (K) of increase in amplitude of the vibrations measured by the pick-up device is reached, this value being characteristic of the approach of the maximal degree of compactness of the treated ballast.

11 Claims, 2 Drawing Figures

PROCESS FOR TAMPING RAILWAY TRACKS AND A MOVABLE MACHINE FOR EFFECTING THE PROCESS

BACKGROUND OF THE INVENTION

The invention relates to a process and a movable machine adapted to tamp railway tracks. A predetermined parameter value, corresponding to the degree of ballast compactness is used in order to vary the tamping process to obtain the same degree of ballast compactness under all the tamped sleepers.

Numerous proposals have been made in this field. It has been admitted for a long time that railway tracks do not present the same faults of position after maintenance operations comprising levelling and tamping as before these operations, it is desirable to tamp the ballast in a manner that results in the same degree of compactness under all the sleepers.

Thus it was proposed in Austrian Pat. No. 194,886 to vary automatically the pressure of the fluid feeding the hydraulic operating motors of the tamping tools of a tamper in function of the value of the resistance which was felt by the tools in the ballast. It was also proposed, in Swiss Pat. No. 333,108, to vary the frequency of the vibrations of the tools of a tamper in function of the local conditions of resistance of the ballast. In another Austrian Patent, No. 198,294, it was proposed to regulate the power of the motor producing the vibrations of the tamping tools in function of fluid pressure existing in the device controlling the tools, which pressure is proportionate to the ballast resistance. Another process illustrated by Swiss Pat. No. 355,170 stopped the tamping at the end of a working cycle when the track began to lift above the normal level under the effect of the force of the ballast beneath the tamped sleeper.

However, not one of the machines described for effecting these diverse processes has been commercially exploited, since their results were unsatisfactory. This emerged from the fact that the proposed adjustments during progress of tamping were a function of the resistance offered by the ballast to the tamping tools. But the value of this resistance varies not only in function of the degree of compactness of the ballast, but likewise as a function of the characteristics thereof, such as its granulation, its hardness, its degree of humidity and its degree of pollution.

It followed that when the resistance of the ballast attained the chosen value during the progress of tamping, the degree of compactness of the ballast could not always be equal under all the tampered sleepers.

The present invention has for its object the provision of a process and a machine for regulating such tamping which avoids this inconvenience by the use of a regulating value, representative of the degree of compactness of the ballast, which is not influenced by the variations of the characteristics of the ballast and which clearly indicates the approach of the maximal degree of compactness.

SUMMARY OF THE INVENTION

To this end, the process in accordance with the invention consists of a process for tamping railway tracks by means of a movable tamping machine so as to obtain the same degree of compactness of the ballast under all the sleepers of the track tamped by said machine, said process comprising tamping the ballast between and under the sleepers of said track with said machine, measuring the amplitude of vibrations retransmitted by the ballast across the sleepers and the rails to a part of the machine maintained in nonelastic connection with at least one rail of the railway track, and stopping the tamping operation as soon as a predetermined value (K) of increase in the measured amplitude is attained, the value (K) being indicative of the approach of the desired maximal degree of compactness of the treated ballast.

The value (K) of the approach of the maximal degree of compactness is pre-established experimentally as a function of the amplitude of the vibrations of the tamping tools and of the position of said part of the machine on which the measurement is effected, with respect to the zone of action of the tamping tools.

This process is based on tests carried out by the applicants which showed that the vibrations developed by the tamping device are transmitted to the track by the machine which is standing thereon, and to the ballast by the action of the tamping tools.

As long as the ballast constituting the seating of a sleeper has not attained a sufficient degree of compactness in the course of tamping, the vibrations transmitted to the constituent parts of the machine and of the track have an amplitude which is substantially constant for each of them but of different intensity in accordance with the part considered.

Then when the seating of tamped ballast attains a degree of compactness approaching its maximum, the vibrations to which the ballast is submitted are retransmitted by the sleeper, and are added to the vibrations already transmitted by the tamping device to the constituent parts of the track and the machine, appearing as a rapid increase in the amplitude of vibration of the parts.

These phenomena are explained by the fact that the maximal degree of compactness of the ballast constituting the seating corresponds to a structure in the form of a mosaic in which the voids have been reduced to a minimum, and which, due to this fact, no longer absorbs the vibrations which are communicated thereto by the tamping tools and transmits them directly to the sleeper, producing the observed increase in the amplitude of the vibrations to which the parts of the track and of the machine are submitted.

These observations are the basis of the solution proposed by the invention, which consists in stopping the tamping operation during the period of increase in the amplitude of the transmitted vibrations. The amount of this increase must be established by experience in accordance with the characteristics of the machine used and the location where the measurement is effected with respect to the zone of action of the tamping tools.

This process is advantageous with respect to known processes since for the first time a control of tamping is proposed based on a value characteristic of the approach of the maximal degree of tamping compactness which is independent of the variations of the characteristics of the ballast.

Diverse methods of applying the process of the invention may be employed without departing from the scope of the invention. One of the preferred methods consists in determining the means amplitude (a) of vibrations measured in the course of tamping, determining the difference between the mean value (a) and the amplitude (A) of each vibration, comparing this difference (A - a) with a predetermined value (K), and finally stopping the tamping operation as soon as the difference value (A - a) attains the value (K).

To eliminate useless information from the measurement, it is preferred to filter the detected vibration frequencies so as only to measure the amplitude of a signal of a frequency corresponding to the frequency of vibration of the tools of the machine operating in the ballast.

To eliminate the possibility of the predetermined value (K) being exceeded due to fortuitous causes independent of the state of compactness of the ballast, such as for example the accidental encounter of the tools with a hard core, it is advantageous to stop the tamping operation only after the value (K) has been attained a certain number (m) of times.

Finally, if at the end of one tamping cycle the predetermined value (K) has not been reached, the cycle is repeated, so as not to leave the sleeper insufficiently tamped.

The apparatus of the invention consists of a movable tamping machine for tamping railway tracks in order to achieve the same degree of compactness of the ballast under all the sleepers of the track tamped by said machine, said machine comprising a tamping device with vibratory tamping tools, a control device for stopping the compacting operation of said tools and adapted to receive a control signal, and a measurement circuit including pick-up means for measuring the amplitude of vibrations retransmitted by the ballast across the sleepers and the rails of the track to a part of the machine which is maintained in non-elastic connection with at least one rail of the track, said pick-up being rigidly fixed to said part of said machine, and a computer adapted to emit said control signal to stop the compacting operation of said tools when a predetermined value (K) of increase in amplitude of the vibrations measured by said pick-up means is reached, this value being characteristic of the approach of the desired maximal degree of compactness of the treated ballast.

The vibration amplitude measurement pick-up can be placed on any part of the machine, provided that this part is in firm non-elastic connection with the track and is responsive to the vibrations transmitted to the track by the ballast. Thus the measurement pick-up can be fixed on an axle near the tamping zone or even on the chassis of the machine if the suspension springing is suppressed during the tamping operation, as it is the custom to do, but it is preferable for convenience of handling to place the pick-up in a position as near as possible to the zone influenced by the tamping, by fixing it on a feeler maintained pressed on a rail.

To put into practice the preferred form of process in accordance with the invention, the movable tamping machine is provided with a measuring circuit comprising a pick-up of the acceleration type, measuring the value (A) of the amplitude of each vibration and connected to a computer comprising a device providing a signal representative of the mean value (a) of the amplitude of a predetermined number (n) of picked-up vibrations, a differential device providing a signal proportional to the difference (A - a) between the value (A) of the amplitude of each generated vibrations and the said mean value (a) of the vibrations, a comparator device connected to a device detecting the value (K) and providing the signal for controlling the stopping of the compacting operation as soon as this said value is reached by the value of the difference signal provided by the differential device.

Preferably the measuring circuit of the machine comprises, separately or in combination:

A frequency filter, inserted between the measurement pick-up and the computer, devised so as only to pass information concerning vibrations the frequency of which corresponds to that of the vibrations of the tools of the machine operating in the ballast.

A counting device inserted between the comparison device and an amplifier, providing a signal for stopping the tamping operation only after receipt of a certain number (m) of impulses of the said control signal.

DETAILED DESCRIPTION OF THE PREFERRED EMBODIMENT

Figure 1:
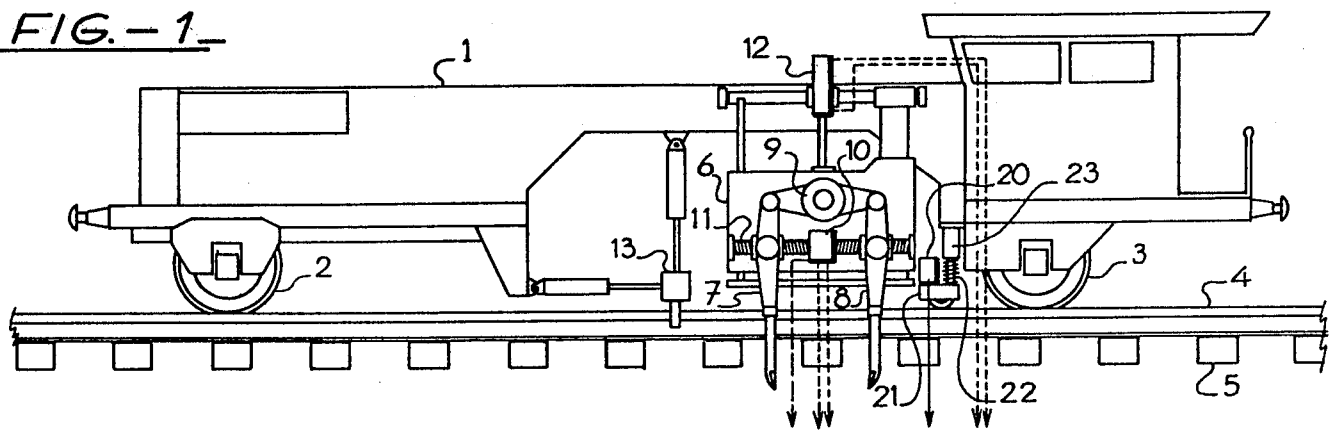
FIG. 1 is a side view of a movable tamping machine for railway tracks the machine being equipped in accordance with the invention.

In FIG. 1 there is shown a tamping machine 1 having to axles 2 and 3 resting on a track including a rail 4 and sleepers 5.

This machine is equipped with a tamping device of a known type, comprising tools working by compression and vibrating at a forced amplitude of constant value, mounted on a plurality of chassis 6 located transversely so as to be able to tamp the whole length of each sleeper of the track.

These tools are mounted in pairs on the chassis 6 and the two tools 7 and 8 of each pair are mutually driven by a motor with an eccentric 9. The eccentric vibrates them by means of crank arms pivoted on their upper ends. The tools are also pivoted near their centers on an oppositely threaded screw-and-shackle mechanism 11, the screw being rotatable by a hydraulic motor 10. The motor increases or decreases the distance between the tool ends in accordance with the direction of rotation of the screw.

Each chassis 6 is vertically movably mounted on guide rods and is operated by a hydraulic jack 12 for lifting and lowering thereof.

There is also a known form of device 13 for the controlled displacement of the track, comprising rail grippers mounted on chassis driven by hydraulic jacks. This device is mounted on the tamper so as to place or replace the track in its correct position during the tamping operation.

Figure 2:
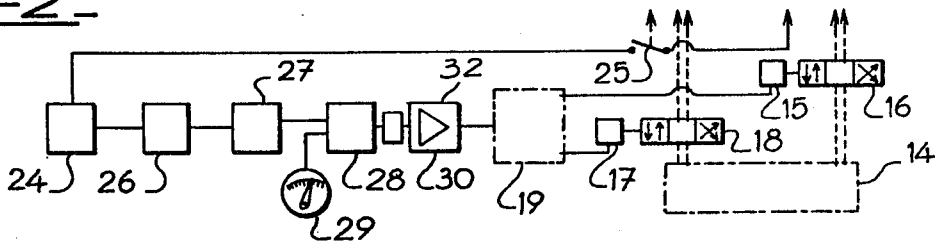
FIG. 2 is a circuit diagram for measuring and controlling the tamping, used in connection with FIG. 1.

In FIG. 2 there is a hydraulic generator represented by a chain dotted rectangle 14. This generator comprises a tank, a pump and a discharge valve for feeding the hydraulic jack 12 controlling the raising and the lowering of the chassis 6, the hydraulic motor 10 operating the screw 11, and the motor with eccentrics 9 with fluid under pressure.

This feed is controlled by an electro-valve 15–16 inserted in the feed circuit of the jack 12 and by an electrically operated valve 17–18 inserted in the feed circuit of the motor 10. These valves have three positions. Thus the valve 15–16 feeding the jack 12 has three positions, one for raising, one for lowering and a neutral (cut-off) position. The valve 17–18 inserted in the feed circuit of the motor 10 has also three positions, rotation left, rotation right and stop.

The feed circuit for the motor 9 has not been shown so as not to encumber the drawing unnecessarily.

The operating coils 15 and 17 of the electrically operated valves are excited by the signals emanating from a sequential control device represented by a chain dotted rectangle 19 to which they are connected.

This sequential control device 19 is of the type in which limit switches are used for tripping each successive operation of each tamping cycle.

In the example shown, at each advance step of the machine to bring the axis of the tamping device above a sleeper, the lowering of the chassis 6 is initiated by the operator, but a limit switch cuts off the lowering operation by returning the valve 15-16 to a neutral position. The limit switch simultaneously sets in motion the subsequent operation of closing the tools 7 and 8 together by operating the hydraulic motor 10 in a suitable direction. Another limit switch controls the closing of the tools and their opening, as well as the raising of the chassis 6 by simultaneous action on the motor 10 and the jack 12. This effectively stops the operation of compacting the ballast under the respective sleeper.

It is on this sequential control device 19 that the measuring circuit of the invention acts.

This measuring circuit comprises a measuring pick-up 20, a frequency filter 24, an average device 26, a differential device 27, a comparison device 28, and an amplifier 30.

The measuring pick-up 20, which is preferably of acceleration type, is rigidly fixed on a feeler 21. This feeler has a cylindrical roller which is pressed on the rail 4 by a spring 22 interposed between the cylinder of a hydraulic jack 23 and the feeler 21. The pick-up 20 is constructed to emit a signal proportional to the amplitude (A) of each vibration collected and is preferably an accelerometer of high natural frequency, for example of a quartz accelerometer, so as to avoid self-resonance under the effect of the vibrations transmitted by the rail 4.

The frequency filter 24 is connected to the pick-up 20 by a circuit which is disconnected at each tamping cycle by a switch 25 energized each time by the change in rotation of the screw 11 to which it is mechanically connected. As a result the signal emanating from the filter is only transmitted during the closing movement of the tools 7 and 8, i.e. during the ballast compacting operation. This frequency filter is constructed so as only to transmit signals which are proportional to the amplitude of signals the frequency of which corresponds to that of the vibrations of the tamping tools 7 and 8.

The average device 26 is connected to the frequency filter 24. The signals emanating from the filter 24 are treated in this device 26 to obtain a resultant signal proportional to the mean (a) of a certain chosen number (n) of the first-measured amplitudes. This device can be for example of a type already known and described in Swiss Pat. No. 474,622, comprising a summation device of the amplitude measurements and means dividing this sum by the number (n) of measures effected.

The differential device 27 is connected to the average device 26. An output signal is created by the device 27 which signal is proportional to the difference (A - a) between each measured amplitude (A) and the mean amplitude (a) determined by the average device 26.

The comparison device 28 has two inputs, one receiving a signal proportional to the difference (A - a) emanating from the differential device 27 to which it is connected, and the other receiving a signal proportional to the predetermined value (K) of increase of the amplitude representative of the approach of the maximal degree of compactness of the ballast, the signal produced by display meter 29. This comparison device 28 delivers a control signal as soon as the two input values are equal, i.e. as soon as the difference (A -a) reaches the value (K).

A counting device, not shown on the design, if preferably provided in the circuit between the comparison device 28 and the amplifier 30. The control signal from the device 28 is only transmitted by this device after a predetermined number (m) of impulses of the control signal have been received by it. As stated previously, this eliminates the possibility of the value (K) being exceeded due to independent fortuitous causes.

The amplifier 30 is connected to the comparison device 28 and delivers an amplified control signal from the comparison device to the previously described sequential control device 19 for disconnecting the stopping of the compacting operation. For example the device 19 operates a relay, located between the limit switch and the valve 17-18, with a contact in the circuit of the limit switch operated by closure of the tamping tools 7 and 8, between the limit switch and the valve 17-18, for controlling the hydraulic motor 10.

At each tamping cycle the switch 25 operated by the change in direction of rotation of the screw 11, cuts off the measuring circuit and the average device 26 is returned to zero. Then the counting restarts at the beginning, for determining the mean value of the amplitude (a) and the difference (A - a).

The invention is not limited to the preferred method and machine described herein but could be adapted to a variety of tamping systems.

What I claim as my invention is:

1. A process for tamping railway tracks by means of a movable tamping machine so as to obtain the same degree of compactness of the ballast under all the sleepers of the track tamped by said machine, said process comprising tamping the ballast between and under the sleepers of said track with said machine, measuring the amplitude of vibrations retransmitted by the ballast across the sleepers and the rails to a part of the machine maintained in nonelastic connection with at least one rail of the railway track, and stopping the tamping operation, as soon as a predetermined value (K) of increase in the measured amplitude is attained, the value (K) being indicative of the approach of the desired maximal degree of compactness of the treated ballast.

2. A process in accordance with claim 1 wherein, during the course of tamping, the mean amplitude (a) of the measured vibrations is determined, the difference between said mean amplitude (a) and amplitude (A) of said vibrations is derived, this difference (A - a) is compared with said value (K) and finally the tamping operation is stopped as soon as the value (A - a) of this difference attains said value (K).

3. A process in accordance with claim 2 wherein the frequencies of the measured vibrations are filtered so that only the measured vibrations which correspond to the frequency of vibration of tools of the machine operating in the ballast are used for the measurement of amplitude.

4. A process in accordance with claim 2 wherein the tamping operation is only stopped after a predetermined number (m) of vibrations following attainment of the value (K).

5. A process in accordance with claim 2 wherein the tamping step is repeated at the same location of the track when the value (K) has not been obtained during a single tamping step.

6. A movable tamping machine for tamping railway tracks in order to achieve the same degree of compactness of the ballast under all the sleepers of the track tamped by said machine, said machine comprising a tamping device with vibratory tamping tools, a control device for stopping the compacting operation of said tools and adapted to receive a control signal, and a measurement circuit including pick-up means for measuring the amplitude of vibrations retransmitted by the ballast across the sleepers and the rails of the track to a part of the machine which is maintained in non-elastic connection with at least one rail of the track, said pick-up being rigidly fixed to said part of said machine, and a computer adapted to emit said control signal to stop the compacting operation of said tools when a predetermined value (K) of increase in amplitude of the vibrations measured by said pick-up means is reached, this value being characteristic of the approach of the desired maximal degree of compactness of the treated ballast.

7. A movable tamping machine according to claim 6 wherein said pick-up means is located in a region near the zone of operation of said tamping tools.

8. A movable tamping machine in accordance with claim 6 wherein said pick-up means is rigidly fixed on a feeler pressed against a rail of the track.

9. A movable tamping machine according to claim 6 wherein the measurement circuit includes an accelerometer measuring the value (A) of the amplitude of each vibration retransmitted by the ballast and connected to said computer and said computer includes an averaging device delivering a signal representative of the mean value (a) of the amplitude of a predetermined number (n) of vibrations, a differential device providing a signal proportional to the difference (A - a) between the value (A) of the amplitude of each measured vibration and said mean value (a) of these vibrations, a comparison device connected to a display device showing the value (K) and emitting said control signal to stop the compacting operation as soon as said value (K) is attained by the value of the difference provided by the differential stage.

10. A movable tamping machine according to claim 9 wherein the measuring circuit includes a frequency filter inserted between the pick-up means and the computer, said filter being adjusted so as only to let pass information concerning vibrations the frequency of which correspond to that of the vibrations of the tamping tools of said machine operating in the ballast.

11. A movable tamping machine according to claim 9 wherein the measuring circuit includes a counting device and an amplifier to amplify said control signal and transmit the amplified signal to said control device, said counting device being inserted between the comparison device and the amplifier and only transmitting said control signal to said amplifier to stop the compacting operation after a predetermined number (m) of impulses of the said control signal have been received.

* * * * *